United States Patent [19]

Hoshino et al.

[11] Patent Number: 4,607,903

[45] Date of Patent: Aug. 26, 1986

[54] CONNECTOR ASSEMBLY

[75] Inventors: Teruaki Hoshino, Higashiyamato; Isao Iimori, Kunitachi; Koichi Kamiji, Utsunomiya, all of Japan

[73] Assignees: Japan Aviation Electronics Industry Limited; Honda Giken Kogyo Kabushiki Kaisha, both of Tokyo, Japan

[21] Appl. No.: 717,789

[22] Filed: Mar. 29, 1985

[30] Foreign Application Priority Data

Mar. 30, 1984 [JP] Japan ..... 59-64245
Mar. 30, 1984 [JP] Japan ..... 59-64246
Mar. 30, 1984 [JP] Japan ..... 59-64247

[51] Int. Cl.[4] ..... H01R 13/44

[52] U.S. Cl. ..... 339/63 R; 339/59 R; 339/210 R

[58] Field of Search ..... 339/59 R, 59 M, 44 R, 339/63 R, 63 M, 210 R, 210 M

[56] References Cited

U.S. PATENT DOCUMENTS 3,239,791 3/1966 Fyrk ..... 339/63 R
4,114,971 9/1978 Heimbrock ..... 339/210 R

*Primary Examiner*—Gil Weidenfeld
*Assistant Examiner*—Paula A. Austin
*Attorney, Agent, or Firm*—Pollock, Vande Sande and Priddy

[57] ABSTRACT

When a socket connector is inserted into an opening of a pin connector, a pin contact of the pin connector makes resilient contact with a socket contact of the socket connector to establish electrical connection therebetween. The pin connector has integrally therewith a connector locking member which is rotatable about an axis substantially perpendicular to the direction of insertion of the socket connector into the pin connector. The connector locking member has formed integrally therewith an engaging projecting which abuts against the rear end face of the socket connector when the connector locking member is turned for locking.

12 Claims, 23 Drawing Figures

FIG. 16
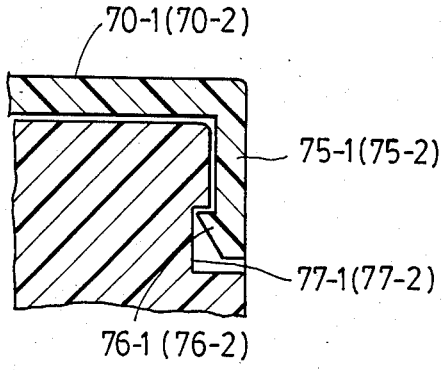
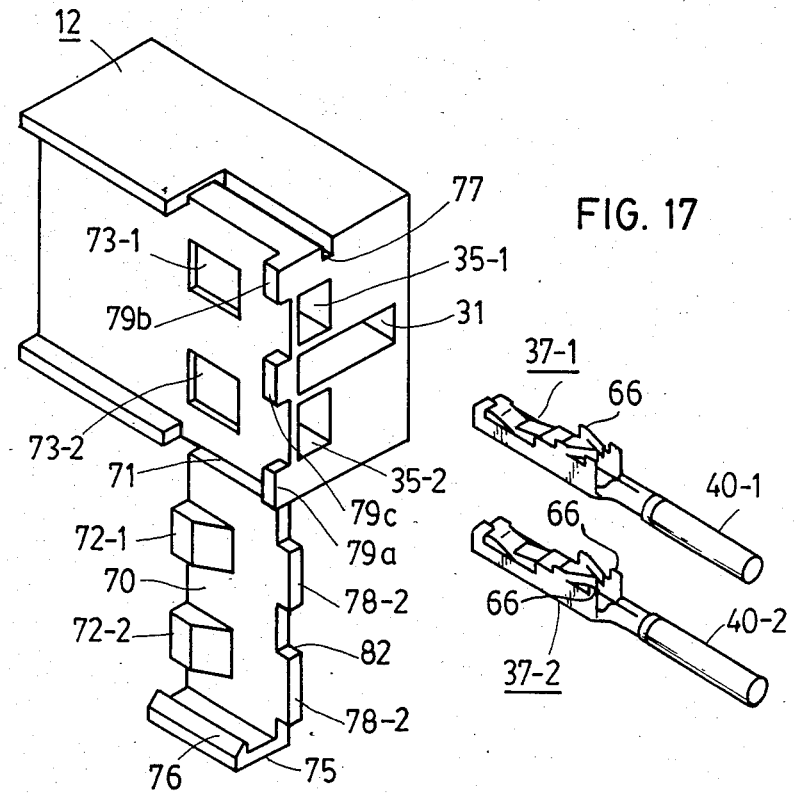
FIG. 17

CONNECTOR ASSEMBLY

BACKGROUND OF THE INVENTION

The present invention relates to a connector assembly which includes a first connector having a first contact and a second connector having a second contact and in which when the second connector is inserted into the first connector, the second contact is automatically brought into resilient contact with the first contact to establish electrical connection therebetween. More particularly, the present invention pertains to a connector structure for holding the first and second contacts in contact with each other.

In this kind of connector assembly heretofore employed, for example, a pin contact is planted on the inside of a pin connector to extend toward its open end portion, and when a socket connector is inserted substantially fully into the pin connector from its open end portion, the pin contact is fitted into a socket contact in the socket connector to resiliently contact it so as to establish electrical connection therebetween.

If the socket connector is not fully inserted into the pin connector, then good electrical connection could not be obtained between the pin contact and the socket contact. Further, the pin contact and the socket contact may sometimes be disconnected from each other owing to vibration or the like. An arrangement that has been employed to avoid this is such that when the socket connector is fully inserted into the pin connector, a click on the front end face of the socket connector engages a click on the inside of the pin connector to lock the two connectors together. The click of the pin connector is provided in association with a resiliently displaceable lever, and a seesaw lever is rockingly mounted on the socket connector in opposing relation to the abovesaid lever. By turning the seesaw lever from the outside, the lever of the pin connector is displaced to disengage the clicks, unlocking the pin and socket connectors from each other. This lock is called a seesaw lock. Another type of lock is called a cantilever lock. According to this, a click is protrusively provided on the inside of the pin connector near its open end portion, and when the socket connector is fully inserted into the pin connector, a click of the cantilever integrally formed with the socket connector on the outside thereof engages the click of the pin connector to lock the pin and socket connectors. By displacing the cantilever to disengage the clicks, the pin and socket connectors can be unlocked.

As the connector assembly is miniaturized, it becomes difficult with the conventional locking systems to detect the locking of the pin and socket connector by the touch or sound of engagement of their clicks. Further, when the miniaturized connector assembly is employed for electrical connection, for example, in a vehicle, it is feared that the contacts may be disengaged from each other due to vibration.

If the socket contact is not held in the socket connector at a predetermined (or normal) position, then it would not make good contact with the pin contact or it would not make any contact therewith when the socket connector is coupled to the pin connector.

To avoid such defects, it has been proposed to trap the contact in the connector, as disclosed, for example, in U.S. Pat. Nos. 4,253,718 (issued on Mar. 3, 1981) and 3,680,035 (issued on July 25, 1972). In either case, however, only one locking system is used. Accordingly, in the case where the connector assembly is small and used at a place where it is frequently subjected to vibration, there is the possibility that the contacts get out of position, resulting in bad contact therebetween.

SUMMARY OF THE INVENTION

It is therefore an object of the present invention to provide a connector assembly which is small-sized but permits easy and correct detection of sufficient contact between pin and socket contacts and ensures holding them in good contact.

Another object of the present invention is to provide a connector assembly which is small-sized but ensures holding a contact in a connector at a correct position.

In accordance with an aspect of the present invention, a connector locking member is formed integrally with the pin connector in a manner to be rotatable with respect to it. The axis of rotation of the connector locking member is perpendicular to the direction in which the socket connector is inserted into the pin connector, and an engaging projection is formed integrally with the connector locking member on one side thereof. When the connector locking member is turned into opposing relation to one side of the pin connector after fully inserting the socket connector into the opening of the pin connector so that the pin contact of the pin connector is in good contact with the socket contact of the socket connector, the abovesaid engaging projection abuts against the back of the socket connector, locking the socket connector to the pin connector. To ensure the locking, engaging means is provided which is comprised of a locking click provided on the connector locking member and a click locking piece on the pin connector for engagement therewith. In the event that the socket connector is not fully inserted into the pin connector, even if the connector locking member is turned for locking, the engaging projection strikes against one side of the socket connector and cannot be located to abut against its back for locking the socket connector to the pin connector, indicating insufficient insertion of the former into the latter.

Further, a pair of projecting pieces are integrally formed with the pin connector to extend therein toward its open end portion and they have clicks at their free ends. An engaging hole is formed through the socket connector for receiving the projecting pieces. When the socket connector is inserted into the pin connector, the projecting pieces are initially resiliently deformed to displace the clicks in a lateral direction, and when the socket connector reaches its correct position, the projecting pieces return to their original state to engage the clicks with engaging portions formed in the engaging hole, thus fastening the socket connector to the pin connector. In this case, the connector assembly is designed so that the locking by the connector locking member is not effected when the clicks do not engage the engaging portions, and this makes it possible to ensure double locking.

A contact housing hole is made in the socket connector to extend therethrough in its lengthwise direction (in the direction of insertion of the connector into the pin connector), and the socket contact is inserted into the contact housing hole from its back and held therein. Locking means is provided in each of the socket contact and the contact housing hole for locking the former in position so that it does not come out of the latter. Moreover, a contact locking member is formed integrally with the socket connector in a manner to be rotatable with respect to it, and its axis of rotation is in the direction of insertion of the socket connector into the pin connector. The contact locking member has formed integrally therewith a blocking projection, and one side of the socket connector has made therein an aperture which communicates with the contact housing hole. Turning the contact locking member to rest on the socket connector after inserting the socket contact into the socket connector, the blocking projection enters into the contact housing hole through the aperture. On the other hand, the socket contact has a pair of opposing projecting portions substantially centrally thereof for engagement with the blocking projection. Accordingly, when the socket contact lies in position, the blocking projection engages the projecting portions of the socket contact to lock the contact so that it does not come out of the socket connector. Means for retaining this engagement is provided in each of the contact locking member and the socket connector. Turning the contact locking member when the socket contact is not held in position, the blocking projection collides with upper edges of the projecting portions and cannot engage them for locking the socket contact. In this state, retention of the engagement of the socket contact and the blocking projection by the abovesaid engagement retaining means is impossible, and this indicates that the socket contact has not been fully inserted into the socket connector. Also in this case, the double locking can be ensured by locking with the contact locking member after locking the locking means of the socket contact and the contact housing hole.

BRIEF DESCRIPTION OF THE DRAWINGS

FIG. 16 is a sectional view showing an example of means for retaining engagement of a contact locking piece with the socket connector;

FIG. 17 is an exploded perspective view illustrating another example of means for locking the socket contact to the socket connector;

DESCRIPTION OF THE PREFERRED EMBODIMENTS

Figure 1:
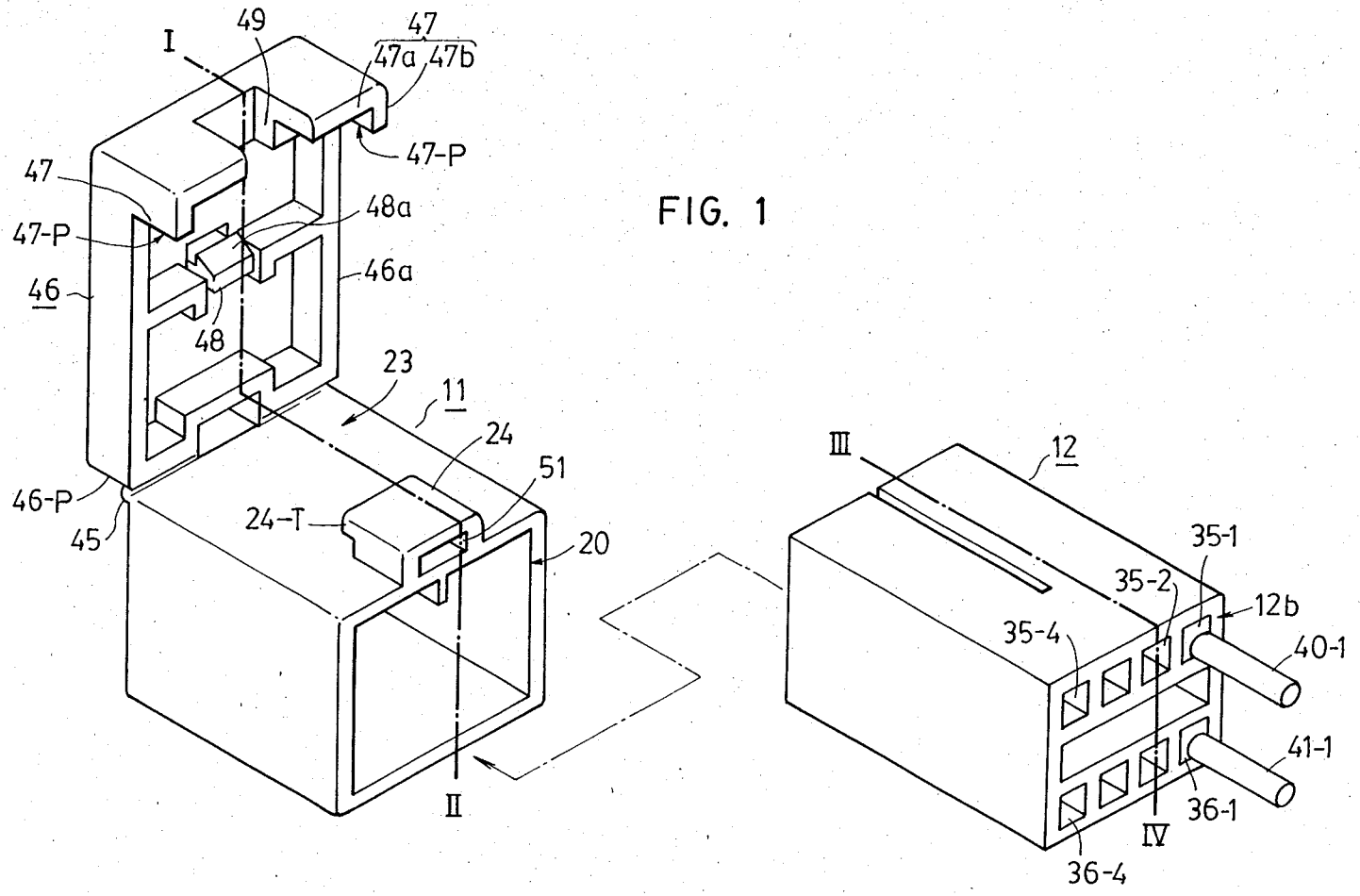
FIG. 1 is a perspective view illustrating an example of the connector assembly of the present invention.

Referring to the drawings, the present invention will hereinafter be described in detail with reference to its embodiments.

Figure 3:
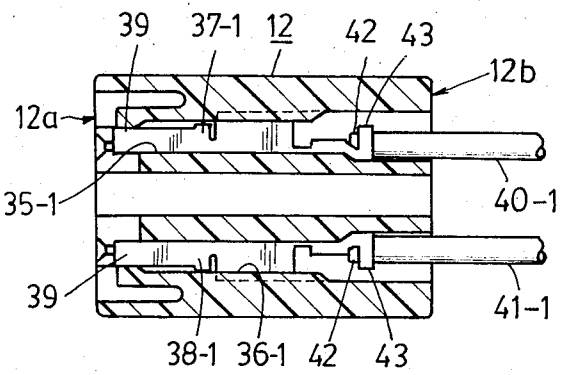
FIG. 3 is a sectional view of a socket connector taken on the line III-IV in FIG. 1.
Figure 2:
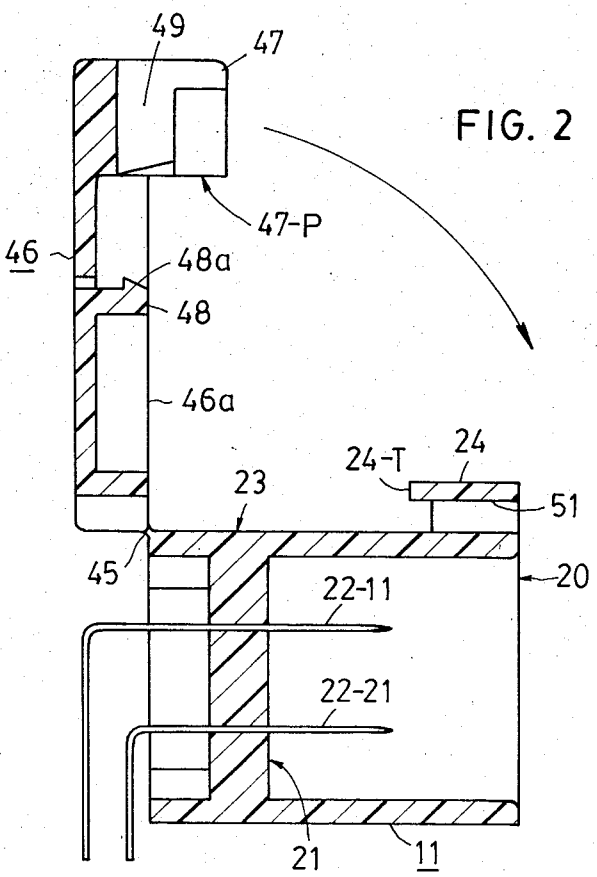
FIG. 2 is a sectional view of a pin connector taken on the line I-II in FIG. 1.

FIG. 1 illustrates, in perspective, an embodiment of the connector assembly of the present invention. A rectangularly-shaped socket connector 12 is removably fitted into a rectangularly-shaped pin connector 11 made of synthetic resin or like insulating material. The pin connector 11 is rectangularly-sectioned and closed at one end but open at the other end for receiving the socket connector 12. As shown in FIG. 2, pin contacts 22-11 and 22-21 are planted substantially perpendicularly on the inner surface 21 of the closed end of the pin connector 11 to extend toward the open end portion 20 thereof. The other ends of the pin contacts 22-11 and 22-21 are led out of the pin connector 11. As depicted in FIGS. 1 and 3, contact housing holes 35-1 to 35-4 and 36-1 to 36-4 are made in the socket connector 12 to extend therethrough in its lengthwise direction so that socket contacts 37-1 to 37-4 and 38-1 to 38-4 are housed and held in the contact housing holes 35-1 to 35-4 and 36-1 to 36-4, respectively. In the drawings, the socket contacts 37-2 to 37-4 and 38-2 to 38-4 are not shown. The contact housing holes 35-1 to 35-4 are arranged side by side along the top panel of the socket connector 12 and the contact housing holes 36-1 to 36-4 are arranged side by side along the bottom of the socket connector 12. In the pin connector 11 are provided pin contacts other than 22-11 and 22-21, corresponding respectively to the relative arrangement of the socket contact housing holes, though not shown. The socket contacts 37-1 to 37-4 and 38-1 to 38-4 have, at one end on the side of the front 12*a* of the socket connector 12, engaging portions 39 into which the corresponding pin contacts are fitted for making resilient contact therewith, respectively. The socket contacts 37-1 to 37-4 and 38-1 to 38-4 respectively have at the other ends engaging portions 43 for electrical contact with conductors 42 of cables 40-1 to 40-4 and 41-1 to 41-4 (40-2 to 40-4 and 41-2 to 41-4 being not shown) which are inserted into the socket connector 12 from the back 12*b* thereof.

When the socket connector 12 is fully inserted into the pin connector 11 from the open end portion 20 thereof, the engaging portion 39 of each socket contact receives the corresponding pin contact to make resilient contact therewith, thus electrically connecting the pin contact with the corresponding cable.

According to the present invention, locking means is provided for locking the pin connector 11 and the socket connector 12 as one body only when the latter is fully inserted in the former to establish good electrical connection between the pin contacts and the socket contacts. In this example, a flap-like connector locking member 46 is hingedly fixed to the upper edge of the pin connector 11 on the side opposite from the open end portion 20 thereof, as indicated by 45. The connector locking member 46 is formed, by molding of synthetic resin, as a unitary structure with the pin connector 11. The end portion of the locking member 46 on the opposite side from the hinge 45 is extended from the connector locking member 46 perpendicularly thereto to form an engaging protrusion 47. The distance between the hinge 45 and the end face 47-P of the engaging protrusion 47 on the side of the hinge 45 is selected so that the end face 47-P abuts against the rear end face 12*b* of the socket connector 12 when the socket connector 12 is fully inserted in the pin connector 11 to the innermost position.

The connector locking member 46 has, at the intermediate portion on the inner surface thereof, a locking piece 48 which is formed integrally with the connector locking member 46 to extend perpendicularly therefrom, and the locking piece 48 has a click 48*a* which is formed to extend in parallel to the connector locking member 46. On the other hand, a projection 24 is formed integrally with the pin connector 11 on its top panel 23 centrally thereof on the side of the open end portion 20, and a locking portion 24-T is formed integrally with the projection 24 at its edge on the opposite side from the open end portion 20. When the connector locking member 46 is pivoted about hinge 45 to the position where the end face 47-P of the engaging protrusion 47 abuts against the rear end face 12*b* of the socket connector 12 inserted into the pin connector 11, the click 48*a* engages the locking portion 24-T.

Figure 4:
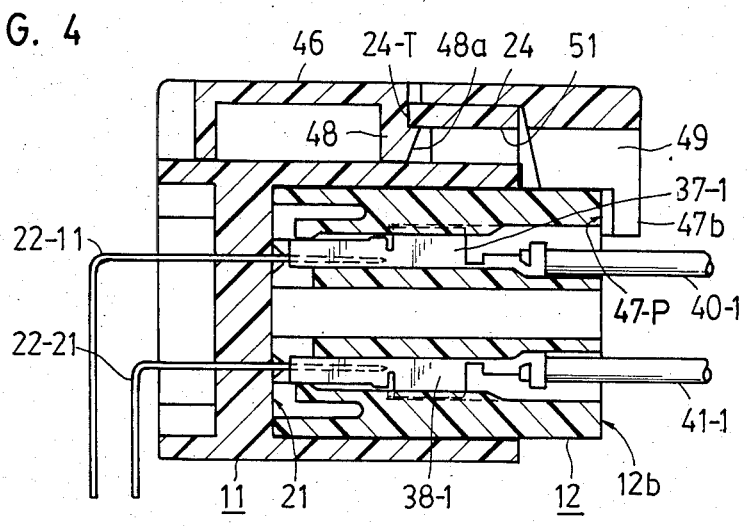
FIG. 4 is a sectional view showing the locked state of the pin connector and the socket connector depicted in FIG. 1.

As illustrated in FIG. 4, when turning down the connector locking member 46 after inserting the socket connector 12 into the pin connector 11 to the innermost position, the end face 47-P of the engaging protrusion 47 abuts against the rear end face 12*b* of the socket connector 11. At this time, the click 48*a* collides with the locking portion 24-T and the locking piece 48 is resiliently deformed, so that the click 48*a* is initially displaced in the direction away from the open end portion 20 and then returned toward it to engage the locking portion 24-T. Thus the socket connector 12 is firmly locked by the connector locking member 46 in position against the pin connector 11 and will not be unlocked by vibration or external force.

When the socket connector 12 is not fully inserted into the pin connector 11, even if the connector locking member 46 is turned down for locking the socket connector 12, the engaging protrusion 47 strikes against the top panel of connector 12, making it impossible to lock the socket connector 12. Accordingly, it is easy to assure the full insertion of the socket connector 12 into the pin connector 11 by turning down the connector locking member 46 to lock the engaging protrusion 47 against the back 12*b* of the socket connector 12 after inserting it into the pin connector 11.

The pin connector 11 and the connector locking member 46 can easily be fabricated by molding as a unitary structure with high accuracy and the socket connector 12 can also be formed by molding with ease and with high accuracy. Accordingly, the present invention permits easy manufacture of a miniaturized and highly reliable connector assembly and ensures complete and stable connection of the socket contacts to the pin contacts.

A rib 46*a* is formed integrally with the connector locking member 46 at its marginal portion all around to reinforce it. The engaging protrusion 47 is formed to project further than the rib 46*a* and made up of a portion 47*a* extending parallel to the axis of rotation of the connector locking member 46 and a portion 47*b* extending at right angles thereto, and hence it is mechanically strong.

A recess 49 is made in the engaging protrusion 47 centrally thereof to extend down past its portion 47*a* and into the rib 46*a*, and a through hole 51 for unlocking use is made in the projection 24 to extend therethrough from the side of the open end portion 20 toward the closed end of the pin connector 11. The socket connector 12 can be unlocked from the pin connector 11 (from the state shown in FIG. 4) simply by urging the click 48*a* toward the hinge 45 with a rod-like unlocking member (not shown) which is inserted through the recess 49 and the through hole 51 so that the click 48*a* disengages from the locking portion 24-T. Since the engagement of the click 48*a* and the locking portion 24-T is hidden from the outside as described above, there is no possibility of an external object coming into direct contact with them, and even if the external object gets in touch with the connector assembly, the click 48*a* and the locking portion 24-T will not be disengaged from each other.

Figure 5:
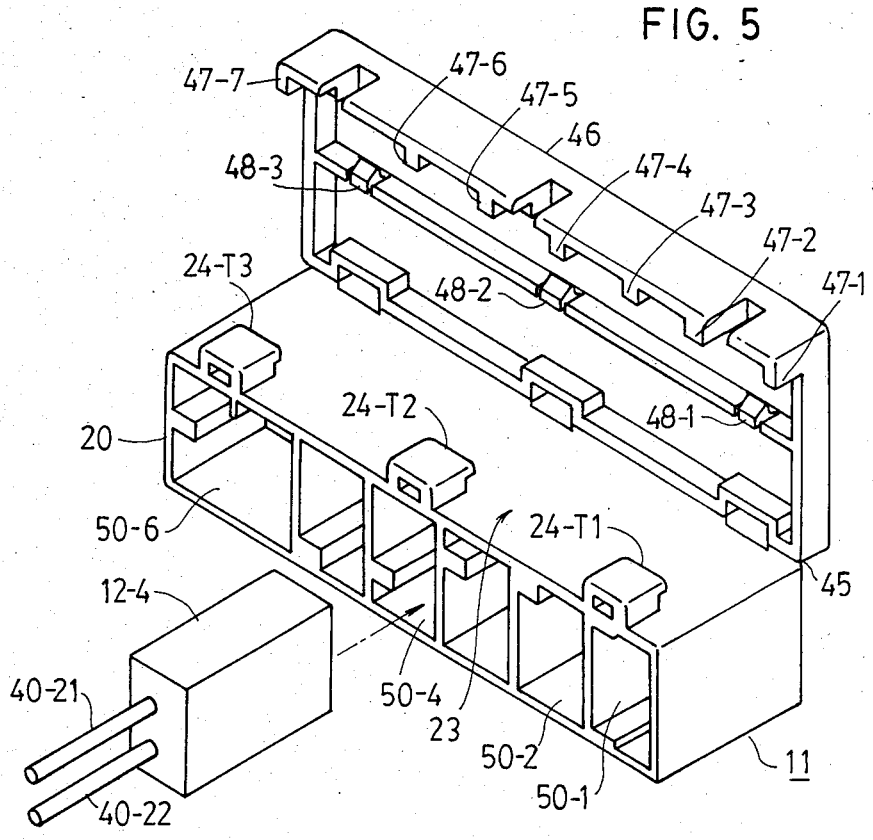
FIG. 5 is a perspective view illustrating an embodiment of the present invention as applied to the case of fitting a plurality of socket connectors into one pin connector.

FIG. 5 illustrates a modified form of the present invention, in which a plurality of openings 50-1 to 50-6 are formed in the pin connector 11 to extend thereinto from its one side 20 and individual socket connectors 12-1 to 12-6 (only the socket connector 12-4 being shown) are inserted into the openings 50-1 to 50-6, respectively. In this case, the connector locking member 46 is provided in common to all the socket connectors 12-1 to 12-6. When turning down the connector locking member 46 for locking the socket connectors 12-1 to 12-6 fully inserted in the pin connector 11, at least one of engaging protrusions 47-1 to 47-7 abuts against the back of each of the socket connectors 12-1 to 12-6. In FIG. 5, both end portions of each of the socket connectors in the direction of their arrangement abut against the engaging protrusions. The engagement between the click 48*a* and the locking portion 24-T at one place may be enough, but in order to ensure the engagement in this example, three locking portions 24-$T_1$, 24-$T_2$ and 24-$T_3$ are provided at proper intervals in the direction of arrangement of the openings 50-1 to 50-6 for engagement with clicks 48-1, 48-2 and 48-3.

Figure 7:
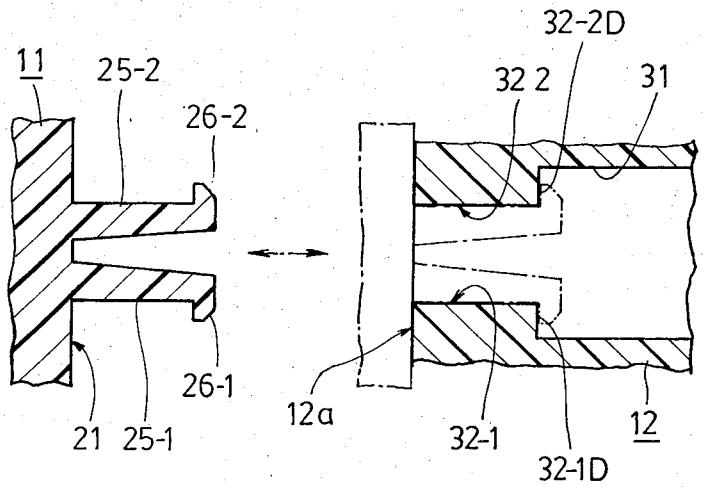
FIG. 7 is a series of sectional views taken on the line V-VI in FIG. 6 and the line VII-VIII in FIG. 8, each showing a part of one of projecting pieces 25-1 and 25-2 and engaging portions 32-1D and 32-2D in the embodiment for double locking.
Figure 6:
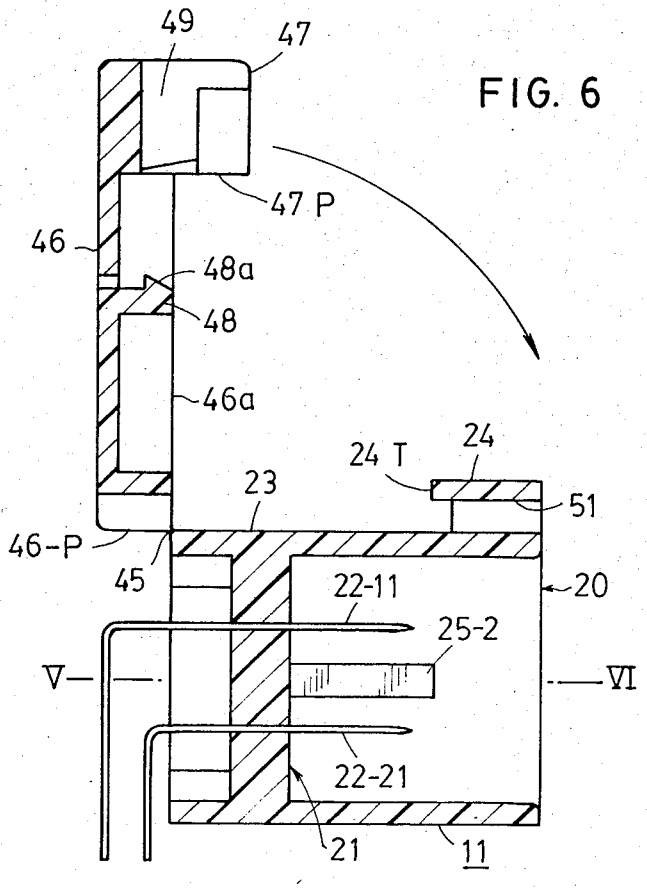
FIG. 6 is a sectional view, corresponding to FIG. 2, showing a pin connector in another embodiment of the present invention which is designed for double locking.

It is also possible to adopt such an arrangement that additional lock means is used for locking the pin connector and the socket connector in their assembled state and then the aforesaid connector locking member is used both for double locking of the pin and the socket connector and for making sure their locking. In this example, projecting pieces, which are displaceable in a direction perpendicular to the direction in which the socket connectors are inserted into or pulled out of the pin connector, are provided as the abovesaid additional lock means, and engaging portions for engagement with projecting pieces are formed in the socket connectors. For example, as illustrated in FIGS. 6 and 7 in which like parts corresponding to those in FIGS. 1 to 4 are identified by the same reference numerals, projecting pieces 25-1 and 25-2 are formed to extend from the inner wall 21 of the closed end of the pin connector 11 substantially centrally thereof toward the open end portion 20. The projecting pieces 25-1 and 25-2 have at their tips clicks 26-1 and 26-2 which extend in opposite directions in the direction of arrangement of the projecting pieces; in FIGS. 6 and 7, they are shown to extend outwardly. The clicks 26-1 and 26-2 are resiliently displaceable in the direction perpendicular to the direction of insertion of the socket connector 12 into the pin connector 11.

Figure 8:
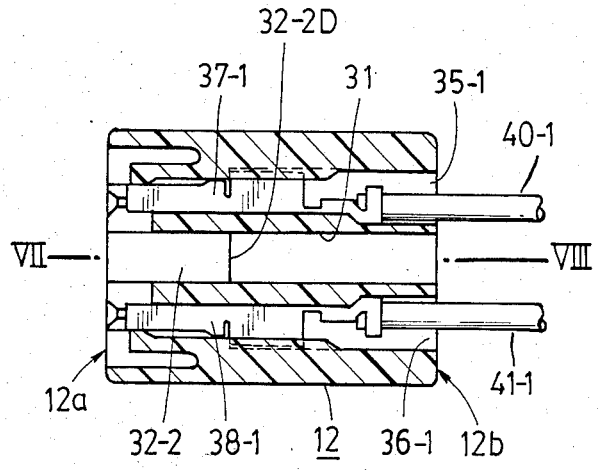
FIG. 8 is a sectional view, corresponding to FIG. 3, illustrating a socket connector in the embodiment for double locking.

As depicted in FIGS. 7 and 8, an engaging hole 31 is made in the socket connector 12 substantially centrally thereof to extend therethrough in its lengthwise direction, and the engaging hole 31 is made narrow from its front end (the front end face 12*a* of the socket connector 12) to its intermediate portion as indicated by 32-1 and 32-2, to provide stepped portions 32-1D and 32-2D at the intermediate position of the engaging hole 31 in its lengthwise direction. The distance from the front end face 12*a* of the socket connector 12 to the stepped portions 32-1D and 32-2D is selected substantially equal to the distance from the inner surface 21 of the pin connector 11 to the base of each of the clicks 26-1 and 26-2 of the projecting pieces 25-1 and 25-2 on the side of the inner surface 21.

When the socket connector 12 is fully inserted into the pin connector 11 to the innermost position to establish good electrical connection between the pin contacts 22-11 to 22-14 and 22-21 to 22-24 and the socket contacts 37-1 to 37-4 and 38-1 to 38-4 corresponding thereto, that is, when the socket connector 12 is correctly fitted into the pin connector 11, the clicks 26-1 and 26-2 engage the engaging portions 32-1D and 32-2D of the socket connector 12, respectively, thus locking the socket connector 12 in position. That is, as the socket connector 12 is inserted into the pin connector 12, slopes of the clicks 26-1 and 26-2 of the projecting pieces 25-1 and 25-2 on the side opposite from the inner surface 21 strike against the front end of the engaging hole 31, and as the socket connector 12 is further inserted into the pin connector 12, the projecting pieces 25-1 and 25-2 are resiliently displaced inwardly to bring their clicks 26-1 and 26-2 closer to each other in the engaging hole 31, after which when the front end face 12*a* of the socket connector 12 reaches the inner surface 21 of the pin connector 11, the clicks 26-1 and 26-2 pass the stepped portions 32-1D and 32-2D and then the projecting pieces 25-1 and 25-2 are restored to their original state, engaging the clicks 26-1 and 26-2 with the stepped portions 32-1D and 32-2D, respectively.

Figure 9:
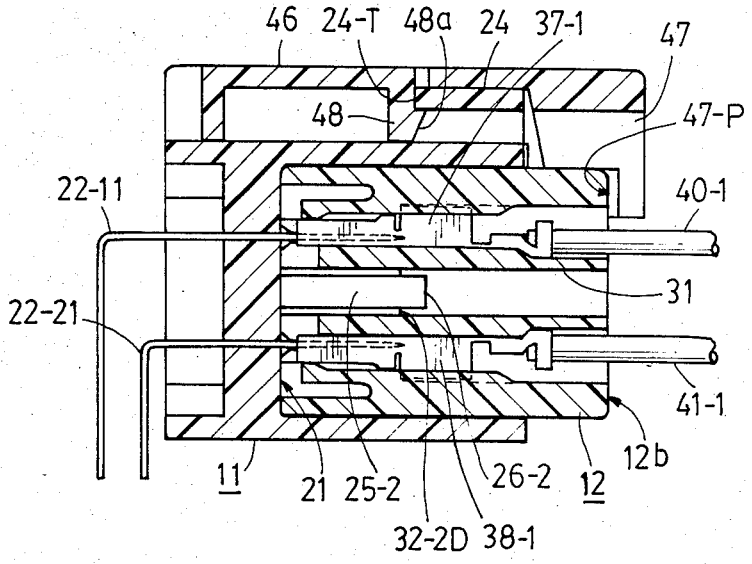
FIG. 9 is a sectional view, corresponding to FIG. 4, showing the assembled state of the pin connector and the socket connector in the embodiment for double locking.

By the engagement of the clicks 26-1 and 26-2 of the projecting pieces 25-1 and 25-2 with the stepped portions 32-1D and 32-2D, the normal insertion of the socket connector 12 into the pin connector 11 can be made sure and they are locked together. Next, the connector locking member 46 is turned down about the hinge 45 to cover the pin connector 11. When the socket connector 12 is fully inserted in the pin connector 11 to the innermost position, the connector locking member 46 is turned down to the position where the end face 47-P of the engaging protrusion 47 abuts against the back 12*b* of the socket connector 11. At the same time, the locking click 48*a* engages the locking portion 24-T, completely locking the socket connector 12 in the pin connector 11, as shown in FIG. 9.

As the socket connector is miniaturized, it becomes difficult to sense, by the aforesaid click, the engagement of the projecting pieces 25-1 and 25-2 with the engaging portions 32-1D and 32-2D and the normal state of insertion of the socket connector into the pin connector. As a result of this, in the event that the clicks 26-1 and 26-2 of the projecting pieces 25-1 and 25-2 are not in engagement with the stepped portions 32-1D and 32-2D, even if the connector locking member 46 is turned down for locking the socket connector 12 by the engaging protrusion 47, since the rear end face 12*a* of the socket connector 12 projects rearwardly more than in the case where the socket connector 12 is fully inserted in the pin connector 11 to the innermost position, the engaging protrusion 47 cannot be brought into contact with the rear end face 12*b*. Further, in this state the click 48*a* cannot be engaged with the locking portion 24-T, either.

Thus, depending upon whether or not the socket connector 12 can be locked with the engaging protrusion 47 by turning down the connector locking member 46 after inserting the socket connector 12 into the pin connector 11 to lock them together by the engagement of the projecting pieces 25-1 and 25-2 with the stepped portions 32-1D and 32-2D, it can be ascertained easily and accurately if the socket connector 12 has been fully inserted into the pin connector 11 as determined.

In the state in which the socket connector 12 is completely locked in the pin connector 11 by such two lock means, since the click 48*a* is also engaged with the locking portion 24-T, the socket connector 12 is locked in the pin connector 11 very firmly and will not be unlocked by vibration or external force.

For disengaging the projecting pieces 25-1 and 25-2 from the engaging portions 32-1D and 32-2D, it is necessary only that after disengagement of the connector locking member 46 from the locking portion 24-T, an unlocking member is inserted into the engaging hole 31 of the socket connector 12 from the side of its rear end face 12*b* to displace the projecting pieces 25-1 and 25-2 so that their clicks 26-1 and 26-2 are moved toward each other to disengage from the engaging portions 32-1D and 32-2D, permitting the socket connector 12 to be pulled out of the pin connector 11.

Figure 10:
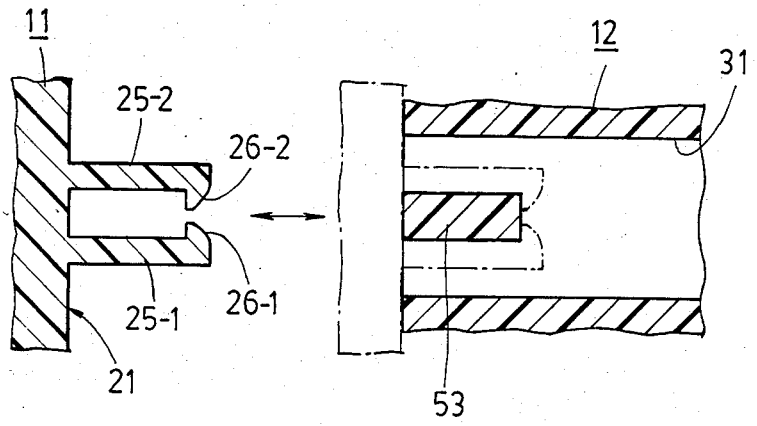
FIG. 10 is a sectional view, corresponding to FIG. 7, illustrating another example of the locking means in the embodiment for double locking.
Figure 11:
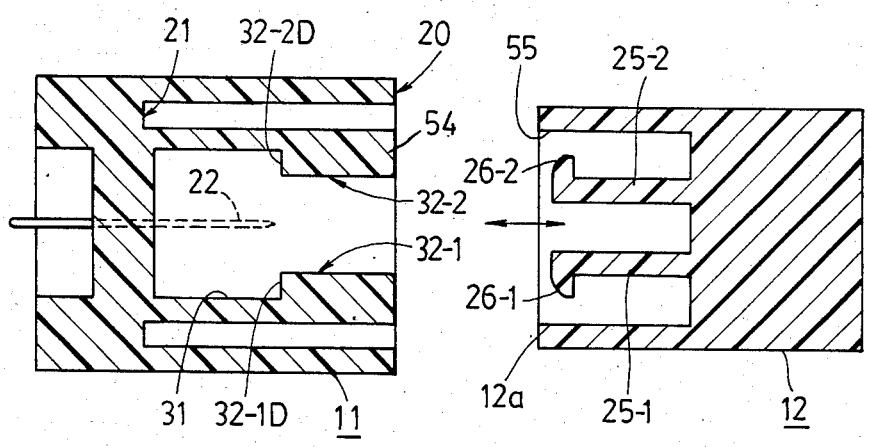
FIG. 11 is a pair of sectional views, corresponding to FIG. 7, showing another example of the locking means in the embodiment for double locking.

The clicks 26-1 and 26-2 may also be formed to extend inwardly of the projecting pieces 25-1 and 25-2 in opposing relation, as shown in FIG. 10. In this case, the front end portion of the engaging hole 31 is divided into two as indicated by 53. With this arrangement, when the socket connector 12 is inserted into the pin connector 11, the clicks 26-1 and 26-2 are initially spread apart from each other by the dividing portion 53 and then engage its back end face. Also it is possible to employ such an arrangement as shown in FIG. 11, in which a block 54 is formed on the inner surface 21 of the pin connector 11 centrally thereof to extend therefrom toward open end portion 20. The block 54 has made therein an engaging hole 31 extending therethrough in its lengthwise direction and the engaging hole 31 has formed therein stepped portions 32-1D and 32-2D raised from its opposing inner surfaces. On the other hand, a hole 55 is made in the front end portion 12*a* of the socket connector 12 centrally thereof for receiving the block 54, and projecting pieces 25-1 and 25-2 are formed on the bottom of the hole 55 to extend therefrom inwardly. When the socket connector 12 is inserted into the pin connector 11, the block 54 enters into the hole 55 and the projecting pieces 25-1 and 25-2 enter into the engaging hole 31 and engage the stepped portions 32-1D and 32-2D, respectively.

Figure 12:
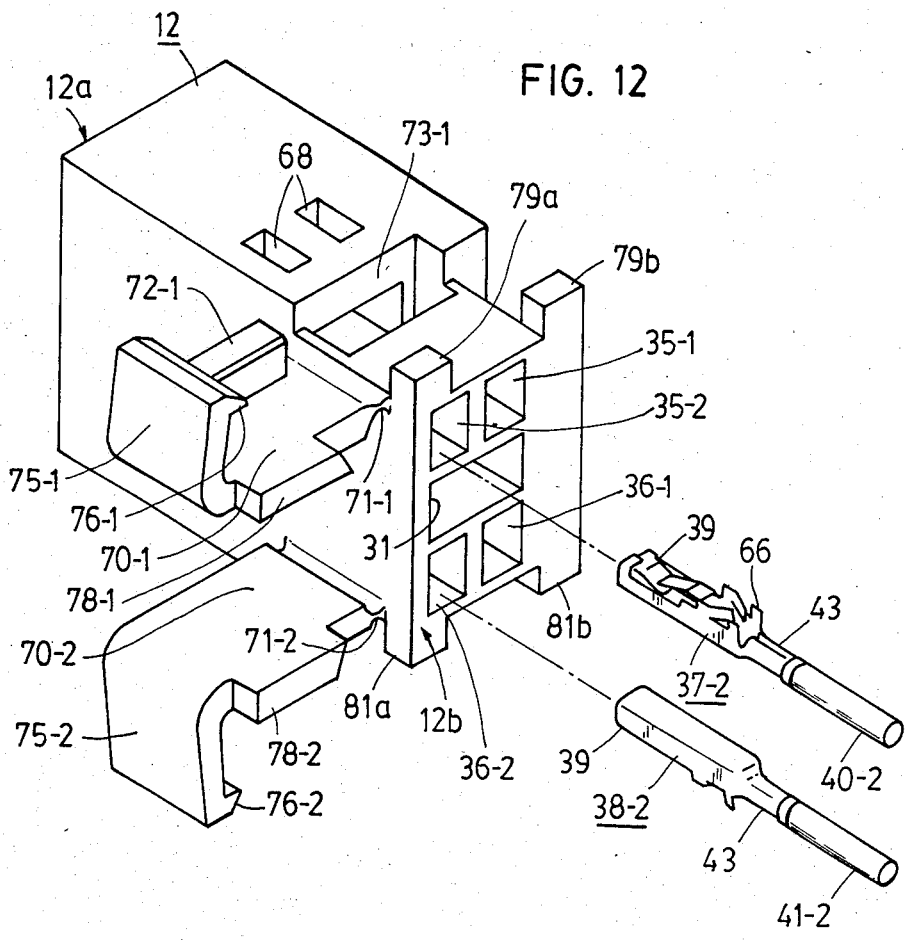
FIG. 12 is an exploded perspective view illustrating an example of locking the socket contact to the socket connector.
Figure 13:
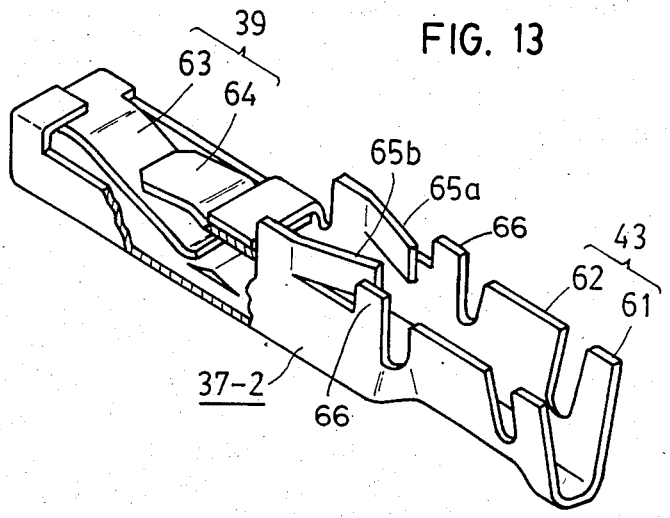
FIG. 13 is a perspective view illustrating an example of the socket contact.
Figure 14:
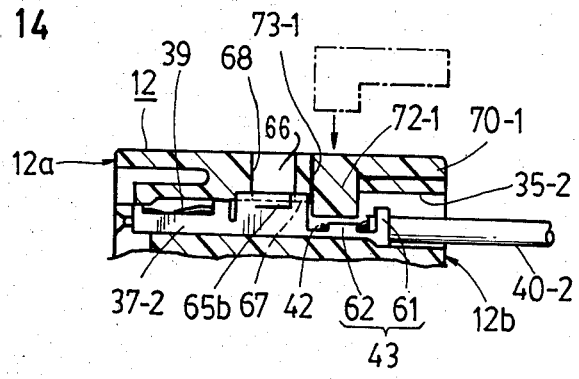
FIG. 14 is a sectional view of the socket contact mounted in the socket connector.

Next, a description will be given of the locking structure of the socket contact itself. In FIG. 12, like parts corresponding to those in FIGS. 1 and 3 are identified by the same reference numerals, and the socket connector 12 is shown to have four contact housing holes 35-1, 35-2, 36-1 and 36-2, but only two socket contacts 37-2 and 38-2 are shown. The contact housing holes 35-1, 35-2, 36-1 and 36-2 are formed in the socket connector 12 to extend therethrough between its front and rear end faces 12*a* and 12*b*, and each socket contact is inserted into the corresponding housing hole. Since the socket contacts are identical in structure, only the socket contact 37-2 will be described. As depicted in FIGS. 13 and 14, one end portion of the socket contact 37-2 forms a cable connector 43, which comprises a pair of coating barrels 61 for staking or gripping the cable 40-2 through its coating and a pair of conductor barrels 62. The end portion of the cable 40-2 is stripped of the coating to expose its conductor 42, which is staked or gripped by the conductor barrels 62 for electrical and mechanical connection to the socket contact 37-2. The other end portion of the socket contact 37-2 forms an engaging portion 39 into which one end portion of the pin contact is fitted for resilient contact therewith. The engaging portion 39 has a square-tubular configuration and its top panel is formed to have main and auxiliary springs 63 and 64 for resiliently urging the inserted pin contact against the bottom panel. Further, the intermediate portion of the socket contact 37-2 is formed to provide a pair of locking lances 65*a* and 65*b* in opposing relation which are formed to approach each other toward the cable connector 43 and to project upwardly relative to the engaging portion 39. Portions of the socket contact 37-2 adjacent free ends of the locking lances 65*a* and 65*b* on the side of the cable connector 43 are formed to extend in parallel to each other as projecting portions 66 having edges perpendicular to the lengthwise direction of the socket contact 37-2.

Figure 15A:
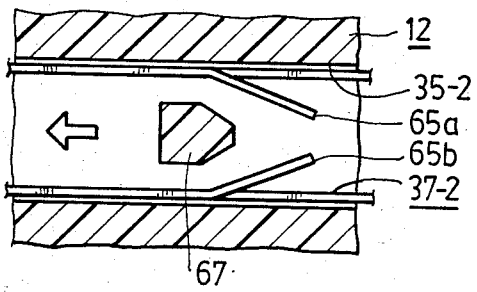
FIGS. 15A to 15C are sectional views showing the relations between locking lances 65*a* and 65*b* and a lug 67 at the time of inserting the socket contact into the socket connector.
Figure 15B:
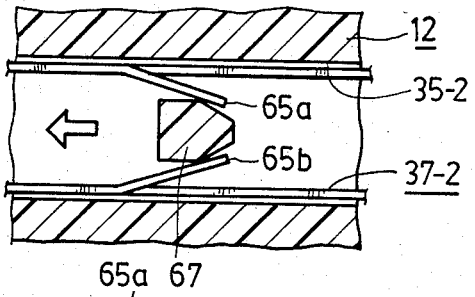
Figure 15C:
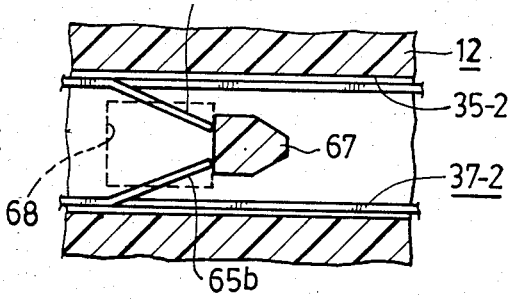

In the contact housing hole 35-2 is formed integrally therewith a lug 67 at its intermediate position, as shown in FIGS. 14 and 15A. When the socket contact 37-2 is inserted into the contact housing hole 35-2, the locking lances 65*a* and 65*b* are resiliently deformed by the lug 67 to spread apart, as shown in FIG. 15B, and upon moving past the lug 67, the locking lances 65*a* and 65*b* are restored to their original state by their resiliency so that their free ends engage the end face of the lug 67 on the side of the front end face 12*a* of the socket connector 12. In this state of engagement the socket contact 37-2 is held in position in the socket connector 12 and locked by the locking lances 65*a* and 65*b* and the lug 67, and hence does not come out. For removing the contact 37-2 from the contact housing hole 35-2, a disengaging hole 68 is made in the socket connector 12 to extend down to the contact housing hole 35-2 in opposing relation to the locking lances 65*a* and 65*b*. A disengaging member is inserted through the hole 68 into the contact housing hole 35-2 to spread the locking lances 65*a* and 65*b* apart to disengage them from the lug 67, permitting the socket contact 37-2 to be pulled out of the contact housing hole 35-2.

The other socket contacts are mounted in the socket connector 12 in the same manner as the socket contact 37-2.

According to the present invention, it is possible to make sure whether the locking lances 65*a* and 65*b* and the lug 67 are in engagement with each other, and further, the socket contacts are locked to the socket connector. To this end, as shown in FIG. 12, a contact locking member is formed as a unitary structure with the socket connector 12 in a manner to be rotatable about a hinge parallel to the direction of insertion of the contacts into the socket connector 12. In the embodiment shown in FIG. 12, two contact locking members 70-1 and 70-2 are pivotally connected to opposite marginal edges of one side panel of the socket connector 12 so that they are rotatable about hinges 71-1 and 71-2 extending in the lengthwise direction of the socket connector 12. The contact locking members 70-1 and 70-2 respectively have at one marginal edge blocking projections 72-1 and 72-2 which project out at right angles thereto. In FIG. 12, only the blocking projection 72-1 is shown.

On the other hand, apertures 73-1 and 73-2 are made in the top and bottom panels of the socket connector 12 to extend in a direction substantially perpendicular to the direction of extension of the contact housing holes 35-1, 35-2 and 36-1, 36-2 and to extend down thereto, respectively. In FIG. 12, only the aperture 73-1 is depicted.

Between the contact locking members 70-1 and 70-2 and the socket connector 12 are respectively provided engagement maintaining means for holding the socket contacts in their locked state. For instance, the contact locking members 70-1 and 70-2 are bent at one end at right angles thereto to form fixing pieces 75-1 and 75-2, the free end portions of which are bent inwardly to form hooks 76-1 and 76-2.

When the socket contacts 37-2 and 38-2 have been inserted into the socket connector 12 to the correct position where the locking lances 65*a* and 65*b* and the lug 67 are in engagement with each other as described previously, the projecting portions 66 lie further to the side of the front end face 12*a* of the socket connector 12 than the apertures 73-1 and 73-2 in the contact housing holes 35-2 and 36-2.

Then, turning the contact locking members 70-1 and 70-2, the blocking projections 72-1 and 72-2 are respectively brought into the apertures 73-1 and 73-2 to project out therefrom and into the contact housing holes 35-2 and 36-2, as shown in FIG. 14, and the hooks 76-1 and 76-2 of the fixing pieces are respectively engaged with recesses 77-1 and 77-2 made in one side panel of the socket connector 12, as depicted in FIG. 16. In this state, since the projecting portions 66 of the socket contacts are in engagement with the blocking projections 72-1 and 72-2, the socket contacts cannot be pulled out of the socket connector. That is, the socket contacts are locked and this locking by the contact locking members 70-1 and 70-2 is maintained by the engagement of the hooks 76-1 and 76-2 with the recesses 77-1 and 77-2.

The engagement of the hooks 76-1 and 76-2 with the recesses 77-1 and 77-2 indicates that the socket contacts have all been inserted into the socket connector 12 and held in position.

When the hooks 76-1 and 76-2 are in engagement with the recesses 77-1 and 77-2, protrusions 78-1 and 78-2 formed at the other marginal edges of the contact locking members 70-1 and 70-2 are respectively held between support posts 79*a* and 79*b* and between 81*a* and 81*b* formed integrally with the socket connector 12, by which it is possible to prevent a play in the rotational movement of the contact locking members 70-1 and 70-2 in the radial direction and in the direction of insertion of the socket contacts into the socket connector 12.

With the socket contacts held in position in the socket connector 12, when the socket connector 12 is inserted into the pin connector 11 to the predetermined position, as mentioned previously, the socket contacts and the pin contacts respectively corresponding thereto are electrically connected to each other. In this case, since each socket contact is held in position, it will not come out of the socket connector 12 by virtue of the double locking which is provided by the engagement between the locking lances 65*a* and 65*b* and the lug 67 and between the blocking projection 72 and the projecting portions 66.

On the other hand, in the event that any one of the socket contacts has not been fully inserted into the socket connector 12, that is, when the socket contact is not held in position, at least one part of its projecting portions 66 lies under the aperture 73. Consequently, even if the contact locking member 70 is turned for locking, the blocking projection 72 strikes against the projecting portions 66 of the socket contact lying out of position, and hence it is not fully inserted into the aperture 73. In this case, the socket contacts are not locked by the contact locking member 70 to the socket connector 12 and the hook 76 of the fixing piece cannot be engaged with the recess 77. By this, it is possible to detect that the socket contact has not correctly been mounted in the socket connector 12.

Figure 18:
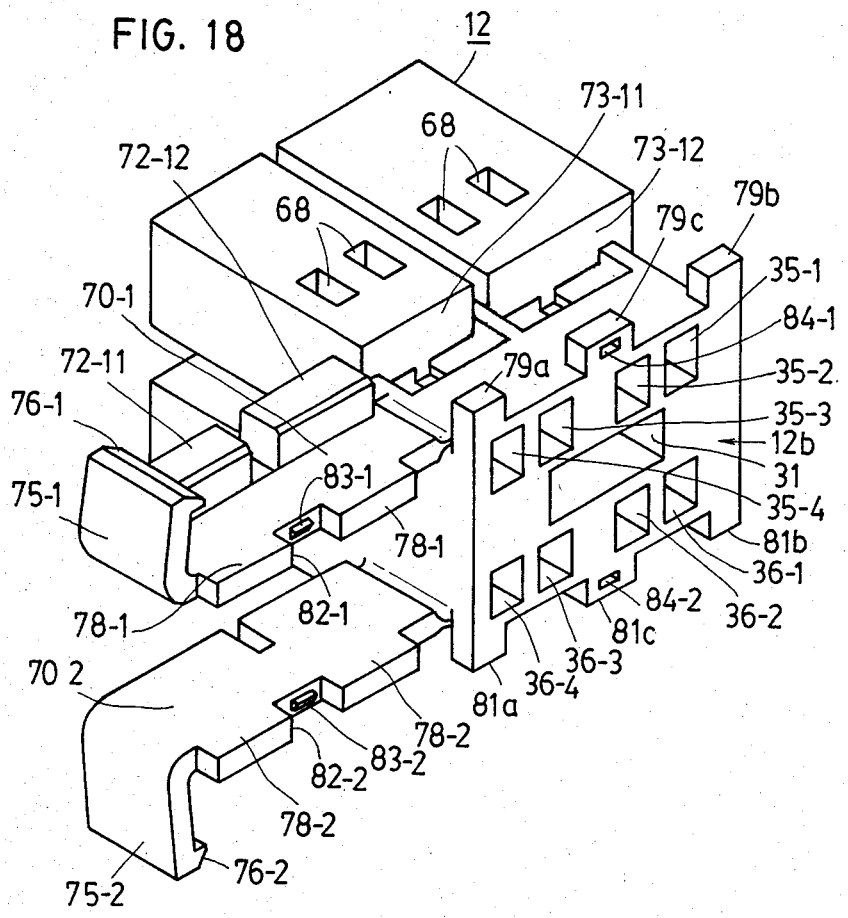
FIG. 18 is a perspective view showing another example of the locking means in FIG. 18.
Figure 19:
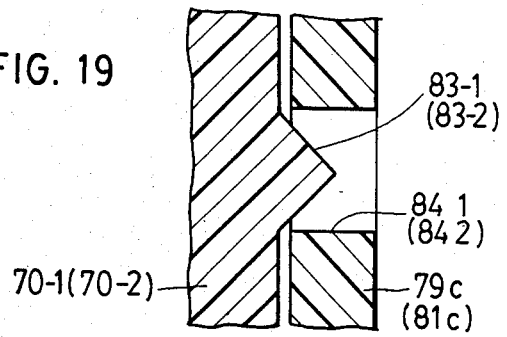
FIG. 19 is a sectional view showing another example of the abovesaid engagement retaining means.

It is also possible to provide the aperture 73 for each contact housing hole and to provide the blocking projection 72 on the contact locking member 70 correspondingly, as illustrated in FIG. 17. Further, as will be seen from FIG. 17, the blocking projection 72 may also be provided so that it is inserted into the contact housing hole from a lateral direction with respect to the projecting portions 66 of the socket contact. In the case where a relatively large number of contact housing holes 35-1 to 35-4 and 36-1 to 36-4 are made, as depicted in FIG. 18, the blocking projection 72 of the contact locking member 70 is divided into two, as indicated by 72-11 and 72-12, and the aperture 73 is also divided into two, as indicated by 73-11 and 73-12, so that the socket contacts are locked by the two blocking projectings 72-11 and 72-12. Further, support posts 79*c* and 81*c* are planted on the socket connector 12 respectively between the posts 79*a* and 79*b* and between the posts 81*a* and 81*b*, and recesses 82-1 and 82-2 are respectively made in the projections 78-1 and 78-2 for receiving the posts 79*c* and 81*c*. Moreover, small triangular lugs 83-1 and 83-2 are formed to project out in the recesses 82-1 and 82-2 (see FIG. 19) and small holes 84-1 and 84-2 are made in the posts 79*c* and 81*c* for engagement with the small triangular lugs 83-1 and 83-2, respectively. When engaging the hooks 76-1 and 76-2 of the fixing pieces with the recesses 77-1 and 77-2 after turning the contact locking members 70-1 and 70-2, the small triangular lugs 83-1 and 83-2 engage the small holes 84-1 and 84-2, further ensuring the locking by the contact locking members 70-1 and 70-2.

Figures 20, 21:
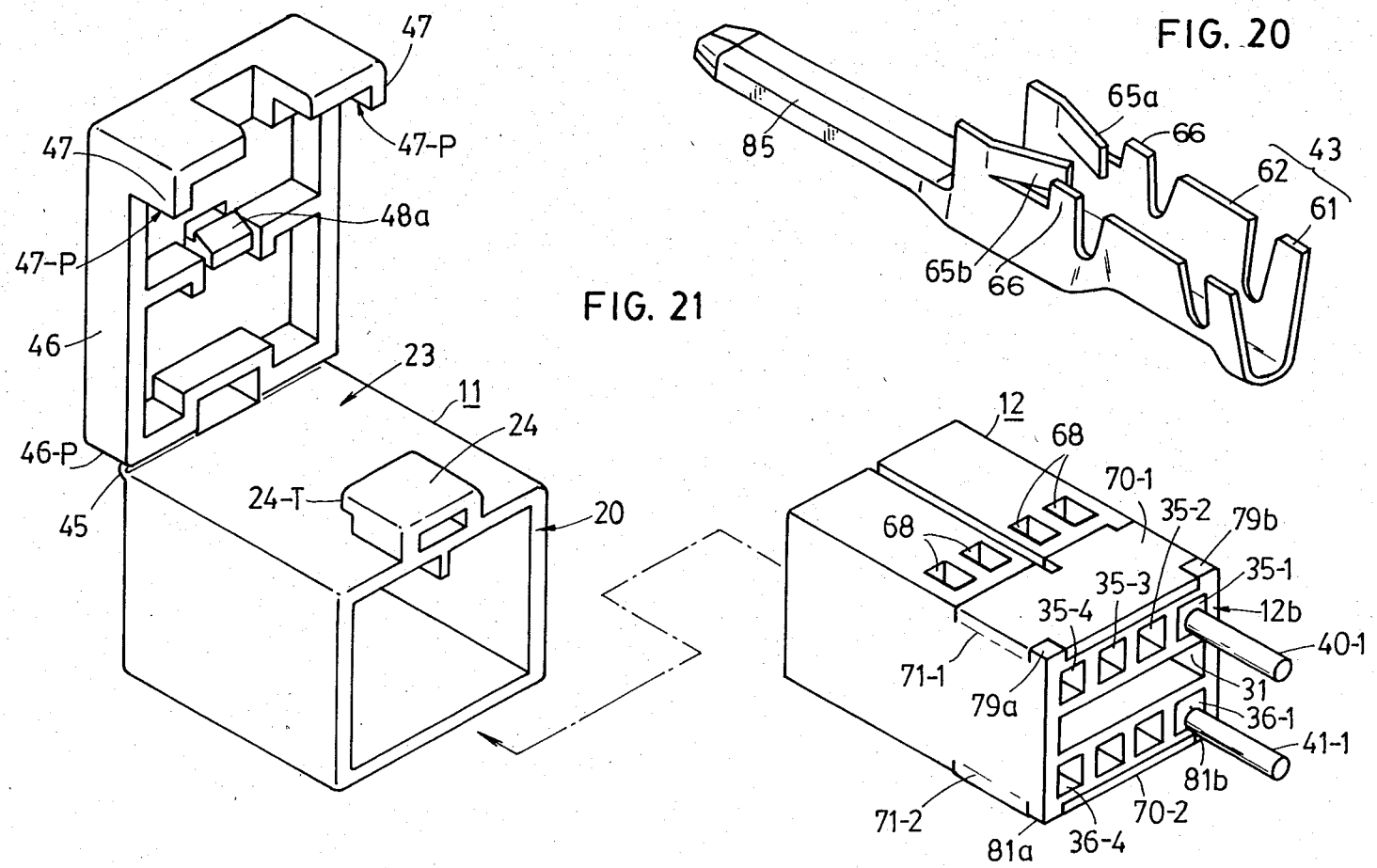
FIG. 20 is a perspective view illustrating a pin contact structure which is suitable for locking to the pin connector by the same locking means as that of the socket contact shown in FIG. 12.
FIG. 21 is a perspective view showing an example of the connector assembly of the present invention using the socket connector depicted in FIG. 12.

Incidentally, in order to firmly hold the pin contact in the pin connector 11, it is also possible to form the pin contact to have the same structure as that of the socket contact which utilizes the double locking by the engagement of the locking lances 65*a* and 65*b* with the lug 67 and the engagement of the projecting portions 66 with the blocking projection 72. The structure of such a pin contact is illustrated in FIG. 20, in which the like parts corresponding to those in FIG. 13 are designated by the same reference numerals. The end portion on the opposite side from the connecting portion 43 is the pin contact body 85, which is formed by bending a sheet metal into a thin square-tube-like form and then crushing down its tip. Contact locking members similar to 70-1 and 70-2 are formed integrally with the pin connector 11 for locking the pin contacts.

In the case where the socket connector 12 having locked therein the socket contacts by the contact locking members 70-1 and 70-2, as described previously with respect to FIG. 12, is fitted into the pin connector 11 provided with the connector locking member 46, as shown in FIG. 21, the contact locking members 70-1 and 70-2 are partly inserted into the pin connector 11, further ensuring the locking of the socket contacts.

It will be apparent that many modifications and variations may be effected without departing from the scope of the novel concepts of the present invention.

What is claimed is:

1. A connector assembly comprising:

a first connector body of a parallelepiped shape formed of a molded synthetic resin, said first connector body having at least one rectangular hole formed therein and defining an open end face and a closed end face opposite to each other;

contact support means provided at the closed end face of said first connector body;

a plurality of pin contacts mounted on said contact support means to extend in parallel to an axis of said rectangular hole toward the open end face thereof;

a second connector body of a rectangular parallelepiped formed of a molded synthetic resin and dimensioned to be snugly insertable into said rectangular hole of said first connector body, said second connector body having formed therein a plurality of contact housing holes extending therethrough in parallel to the inserting direction of said second connector body to communicate between front and rear faces thereof;

a plurality of socket contacts mounted in said contact housing holes of said second connector body, for resilient engagement with said pin contacts to establish electrical connection therebetween when said second connector body is inserted into said rectangular hole of said first connector body;

a plate-like connector locking member having one end rotatably connected with one edge of said closed end face of said first connectory body via a hinge, said hinge being so positioned that said locking member is adapted to be rotated about said hinge and thereby folded over one of the side faces of said first connector body, a free end of said connector locking member remote from said hinge having an engaging projection formed integrally therewith to extend perpendicularly thereto on the side of an inner face thereof to be overlaid on said one side face of said first connector body for abutting against said rear end face of said second connector body thereby to lock said seocnd connector body to said first connector body and prevent said second connector body from coming out of said first connector body, the length of said connector locking member from said hinge to the nearest edge of said engaging projection defining a depth to which said second connector body is required to be inserted into said first connector body to assure good electrical contact between said pin contacts and said socket contacts; and first and second engaging means formed on said one side face of said first connector body and said inner face of said connector locking member integrally therwith, respectively, so that when said connector locking member is folded over said one side face, said first and second engaging means are hidden between said connector locking member and a side wall of said first connector body and engage one another to prevent said connector locking member from pivotally departing from said one side face of said first connector body.

2. A connector assembly according to claim 1 wherein said first engaging means is a fixed engaging member formed as a land projecting from said one side face integrally with said first connector body and having a through hole communicating with the opposite end faces of said land, said second engaging means being a resilient click piece projecting from said inner face of said connector locking member and having a hook formed at a free end portion of said resilient piece to extend parallel to said inner face, for engagement with said through hole so that when said connector locking member is folded over said one side face of said first connector body, said resilient piece is resiliently displaced by one of said opposite end faces of said land whereafter said hook snaps into said through hole, said hook being disengageable from said through hole by pushing against said hook through said through hole.

3. A connector assembly according to claim 1 wherein a contact locking member having a blocking projection is formed integrally with said second connector body at a rear part thereof in a manner to be rotatable about a second hinge defined along one of the corner edges of said second connector body in parallel to said contact housing holes; and a recess having an aperture formed in one of the side faces of said second connector body for receiving therein said contact locking member so that when said contact locking member is folded into said recess the outer surfaces of said contact locking member become flush with the side faces of said second connector body and said blocking projection engages with at least one of said socket contacts through said aperture; the depth of said rectangular hole in said first connector body being so preselected that when said second connector body is inserted into said rectangular hole to establish electrical contact between said pin contacts and said socket contacts, a rear end portion of said first connector body defining said open end face thereof covers at least a part of said contact locking member.

4. A connector assembly according to claim 1 wherein said first connector body has made a plurality of said rectangular holes therein, a plurality of said second connector bodies being removably insertable into said plurality of rectangular holes respectively, the arrangment being such that when said connector locking member is folded over said one side face of said first connector body with said second connector bodies inserted therein, said engaging projection abuts against the rear end faces of respective said second connector bodies.

5. A connector assembly according to claim 1 or 4 wherein a reinforcement rib is formed integrally with the connector locking member on said inner face thereof; and the engaging projection being formed to extend beyond the reinforcement rib.

6. A connector assembly according to claim 1 wherein one side face of said second connector body has an aperture communicating with at least one of said contact housing holes; a lug formed on an inside wall surface of each of said contact housing holes; each of said socket contacts having an elongated body; a locking lance formed at middle portion of each said socket contact integrally therewith to extend rearwardly in a lengthwise direction of said socket contact, the rear free end of said locking lance being positioned for engagement with said lug; a projecting portion formed on each of said socket contacts integrally therewith at the rear of said locking lance to project perpendicularly to the lengthwise direction of said socket contact, a contact locking member formed integrally with said second connector body for rotation about a hinge axis that is parallel to the insertion direction of said socket contacts into said contact housing holes; a blocking projection formed integrally with said contact locking member to extend perpendicularly to the insertion direction of said socket contacts into said contact housing holes such that when said contact locking member is folded over said one side face of said second connector body said blocking projection fits into said aperture to be disposed behind a rear edge of said projecting portion of at least one of said socket contacts, thereby to lock said socket contact into place; and engagement retaining means provided at the free end of said contact locking member remote from said hinge axis, and at a portion of said second connector body, for retaining the engagement between said blocking projection and the rear edge of said projecting portion of said socket contact.

7. A connector assembly according to claim 6 wherein said engagement retaining means comprises a click formed on said free end of said contact locking member integrally therwith and a recess for engagement with said click, said recess being formed in another side face of said second connector body adjoining said one side face on which said contact locking member is folded.

8. A connector assembly according to claim 6 wherein said contact locking member comprises a rear projection formed integrally therewith to project rearwardly, and said second connector body comprises a pair of support posts formed integrally therewith at both rear corners of said one side face for holding therebetween said rear projection when said contact locking member is folded over said one side face of said second connector body.

9. A connector assembly according to claim 6 wherein each of said socket contacts comprises a further locking lance formed integrally therewith at middle portion thereof in opposing relation to said first-mentioned locking lance and slightly oriented toward said first-mentioned locking lance thereby to define a pair of locking lance so arranged that, as said socket contact is inserted into a corresponding one of said contact housing holes, said pair of locking lances are initially spread apart by said lug, and when said socket contact is further inserted into said contact housing hole said pair of locking lances move past said lug and resiliently spring back toward one another to narrow the gap therebetween, thereby to prevent said socket contact from coming out of said contact housing hole.

10. A connector assembly according to claim 1 wherein there is provided at least one projecting piece means, which is resiliently displaceable in a lateral direction with respect to the direction of insertion of the second connector body into the first connector body, and which is formed integrally with one of the first and second connector bodies; and an engaging portion formed in the other of the first and second connectors for engagement with the projecting piece means.

11. A connector assembly according to claim 10 wherein the projecting piece means is formed by first and second projecting pieces extending substantially in parallel to the direction of insertion of the second connector body into the first connector body; first and second clicks formed integrally with the first and second projecting pieces at their projecting ends to extend outwardly in the direction of arrangement thereof; and an engaging through hole in the other of the first and second connector bodies extending in the direction of insertion of the second connector body into the first connector body; the width of the engaging hole in the direction of arrangement of the first and second projecting pieces being made slightly smaller than the spacing of the first and second clicks on the side of the front end of the other of the first and the second connector bodies and larger than the spacing of the first and second clicks on the opposite sides, to form engaging stepped portions as the engaging portion of the intermediate portion of the engaging hole.

12. A connector assembly according to claim 10 wherein the projecting piece means is formed by first and second projecting pieces extending substantially in parallel to the direction of insertion of the second connector body into the first connector body; first and second clicks formed integrally with the first and second projecting pieces respectively at their projecting ends to extend inwardly in the direction of arrangement thereof; an engaging through hole in the other of the first and second connector bodies oriented in the direction of insertion of the second connector body into the first connector body; a member for dividing the engaging through hole into two, said member being formed integrally with the other of the first and second connector bodies in the engaging through hole on the side of the front end of the other of the first and the second connector bodies; the width of the hole dividing member being larger than the spacing of the first and second clicks; and the end face of the hole dividing member on the opposite side from the side of the front end of the other of the first and second connector bodies forming the engaging portion for engagement with the first and second clicks.

* * * * *